United States Patent [19]

Frank et al.

[11] B 3,991,526

[45] Nov. 16, 1976

[54] SYNTHETIC FIBROUS BUFF

[75] Inventors: Burton E. Frank, Shoreview; Lloyd W. Legacy, White Bear Lake; Dean S. Walker, Grant Township, Washington County, all of Minn.

[73] Assignee: Minnesota Mining and Manufacturing Company, St. Paul, Minn.

[22] Filed: May 12, 1975

[21] Appl. No.: 576,859

[44] Published under the second Trial Voluntary Protest Program on February 24, 1976 as document No. B 576,859.

[52] U.S. Cl. ..... 51/358; 51/297; 51/394; 51/400; 51/404; 15/230.15; 15/230.17; 15/230.19

[51] Int. Cl.[2] ..... B24D 17/00; B24D 11/00; A47L 25/00; B24D 13/04

[58] Field of Search ..... 51/297, 293, 401–404, 51/375; 15/230.1, 230.18, 183, 179

[56] References Cited

UNITED STATES PATENTS

| | | | |
|---|---|---|---|
| 2,108,985 | 2/1938 | Hague | 15/230.15 |
| 2,885,834 | 5/1959 | Rock | 15/230.14 |
| 3,260,582 | 7/1966 | Zimmer et al. | 51/401 |
| 3,387,956 | 6/1968 | Blue | 51/297 |
| 3,597,887 | 8/1971 | Hall | 51/400 |
| 3,733,754 | 5/1973 | Jeske | 51/358 |

*Primary Examiner*—Othell M. Simpson
*Attorney, Agent, or Firm*—Alexander, Sell, Steldt and DeLaHunt

[57] ABSTRACT

A synthetic fibrous buff composed of layers of nonwoven mats of synthetic organic fibers impregnated with an oil-, water-, and grease-resistant polymeric binder material provides a light-weight smooth running buff which is quiet, clean and cool to operate. Certain of the buffs are useful in high temperature environments such as for wiping molten solder from freshly soldered container seams.

15 Claims, 3 Drawing Figures

SYNTHETIC FIBROUS BUFF

This invention relates to fibrous buffs formed of synthetic fibers.

Buffs, or buffing wheels as they are sometimes referred to, are generally formed from layers of woven fibrous material which are fastened together, for example, by sewing, stapling, adhesive bonding or plastic or metal clinch rings, and supported for rotation. Such devices have long been used to finish items such as machined parts, stamped parts, and cast articles which very often have surfaces which must be modified, generally for aesthetic purposes. Buffing is a finishing process which is typically accomplished after more rigorous treatment of the surface by polishing.

Finishes obtained by buffing are generally categorized into four types: "satin finishing" for producing satin, brushed or butler finishes; "cut-down buffing" for producing preliminary smoothness; "cut and color" buffing for producing intermediate luster; and "color buffing" for the production of a high gloss or mirror finish. Satin finishes are generally obtained by applying to the periphery of the buff a greaseless compound comprising a glue base binder containing fast-cutting abrasives such as 180 to 220 grade aluminum oxide or silicon carbide. For finer effects, finer sizes of American emery and hard silica may be employed. For butler finishes on silver plate and sterling, fine buffing powders of unfused aluminum oxide and soft silica may be used. Bright butler finishes may be produced by extremely fine greaseless compositions made with binders lubricated with certain fats and waxes such as stearic acid, hydrogenated fatty acids, tallow, hydrogenated glycerides and petrolatum. Grease base binder and fine cutting buffing powders are employed for cut-down buffing. The finest abrasive powders are employed for color buffing. Metal Finishing, published annually by Metals and Plastics Publications, Inc., Hackensack, N.J. is an excellent reference which discloses in detail the various compositions which are typically employed to obtain the finishes described above and a variety of buff constructions.

The buff must not only be capable of withstanding the strenous use conditions typically encountered in buffing operations, but it must also be capable of holding the aforedescribed buffing compositions on its buffing surface.

The particular construction of a sewn buff will depend upon its ultimate use. Buffs formed of layers of fabric which are sewn together are typically used for cutting. Very close rows of stitching increase the stiffness of sewn buffs to increase cut. The sewing patterns for such buffs may vary, depending upon the needs of the user, from concentric sewn, radial sewn, square sewn, spiral sewn, to radial arc sewn and radial arc with spiral center. Concentric sewing results in non-uniform density when the buff wears. As the buff wears closer to the stitches, the buff will become harder and just past a row of stitches it becomes softer. Spiral sewing results in a more uniform density, although the buff surface will still have a density variation. Square and non-concentric sewing patterns produce pockets that may aid in holding buffing compound.

The puckered or pleated buff is popular for its cool running capability, provided by pleats or puckers in its fabric. The type of the construction of a puckered buff depends upon its ultimate use also. Different hardnesses may be required for various cutting and/or color buffing applications. Hardness may be controlled somewhat by the spacing of buffs on the mandrel, but more commonly is regulated by the degree of puckering, the diameter of the buff relative to the clinch ring diameter, or the stiffness of the buff fabric. The stiffness of a woven buff fabric is regulated by the tightness of the weave of the fabric or by the addition of sizing agents such as starches or stearates. A soft, color buff would typically have a thread count of 64 by 64 per inch (2.5 cm), where a typical cut-and-color buff would have a thread count of about 92 by 92, as would a hard, cutting buff, but with the addition of stiffening agents to the latter.

The materials from which the layers in buffs have been composed typically include cotton, sisal, wool and paper, with cotton being by far the most popular. Sisal is a long coarse fiber that is twisted into strands and woven evenly into a fabric for use in buffs. Sisal fabric layers are often interleaved with cotton fabric layers to form buffs, but buffs made entirely of sisal or cotton are also very common. Buff layers are also typically formed of layers of muslin, flannel or wool.

Buffs formed of layers of woven material have been found to have a serious disadvantage since such woven layers tend to unravel in a square configuration due to the nature of weaving. As this occurs, it forms corners in the woven piece where the outermost weft and warp threads meet, creating localities of different density at the periphery of the buffing surface which prevents the buff from running smoothly and may produce a non-uniform finish. Placing adjacent layers such that their weaves are on a slight bias would spread out these sites of uneven density, but does not eliminate them.

Additionally, woven buffs are notoriously dirty because, as they are used, the woven fabric disintegrates spewing thread-like residue into the surrounding area. Woven buffs may also create a hazard because the long threads tend to grab a small work piece from the hands of the user.

U.S. Pat. No. 2,108,985 discloses incorporating a mass of tangled fibers which are not woven between alternate layers of woven fabric to prevent ridging and grooving in the surface of the work piece but this construction does not completely eliminate the problem because the woven fabric is still required in the buff to hold the loose fibers together. U.S. Pat. No. 145,492 discloses a buffing wheel formed of a non-woven wool felt but this buff is relatively heavy, dense, not conformable to irregular surfaces and has a very short wear life.

SUMMARY OF THE PRESENT INVENTION

The present invention provides a fibrous buff composed of layers of non-woven fabric formed of adhesively bonded synthetic organic fibers. The buffs of the invention are lighter in weight and more uniform running, as well as being generally quieter, cleaner and cooler to operate, than the buffs of the prior art. The buffs of the invention are capable of holding buffing compounds on their buffing surfaces, and when used, provide a buffing action in some respects equivalent to woven buffs, and, in other respects superior to woven buffs, as will be explained herein. Additionally, the non-woven fabric of the buffs of the invention will not unravel as does the woven fabric of the buffs of the prior art. The buffs of the invention are therefore much safer to use because they do not produce long threads which could grab a work piece.

While the relative amount, by weight, of material lost during the buffing operation from the buff of the invention is about the same as that lost from a woven buff, the buff of the invention is approximately one third the weight of its woven counterpart, and thus the total weight loss is considerably less. Additionally, the non-woven buff of the present invention will disintegrate cleaner because the non-woven fibers break off in small pieces which create a lint or powdery residue rather than the stringy residue resulting from using a woven buff. The residue of buffs of the invention is therefore considerably easier to remove by conventional air exhaust systems.

The buffs made in accordance with the invention may be of any design or style presently known or contemplated in the future. The most popular forms of buffs are depicted by FIGS. 1–3 of the drawing.

FIG. 1 shows perhaps the simplest form of buff 10 composed of layers 11 of non-woven fabric sewn with one or more circles of stitching 12 with suitable thread which is known for this purpose between the outer edge 13 and central opening 14 which may contain a core of a more rigid material adhered therein by a suitable adhesive binder. Layers of non-woven material have a generally circular shape and they are stacked (or the entire assembly is cut) so that the edges of each of the layers define a cylindrical surface which is the peripheral edge of the buff.

FIG. 2 shows a buff 20 composed of layers 21 of bonded non-woven synthetic fibers sewn together with several circular patterns 22 of stitching with suitable thread. The sewing pattern may be concentric (as shown), spiral, square, radial, radial arc, or a combination thereof. Buff 20 has a central opening 24 into which a suitable mandrel may be inserted for rotation of the buff.

FIG. 3 depicts what is known as a "puckered" buffing wheel 30 which is produced by cutting a continuous strip of non-woven synthetic material and convolutely wrapping this strip around the separated ends of axially aligned cylindrical mandrels, radially constricting the wrapped strip at its middle to form a flattened "puckered" annulus, and installing a rigid clinch ring 33 of either plastic or metal within the opening of the annulus. A "puckered" fabric annulus may also be fastened by stapling, sewing or adhesive bonding to a suitable rigid annulus such as an annulus formed of cardboard.

DETAILED DESCRIPTION OF THE INVENTION

Figure 1:
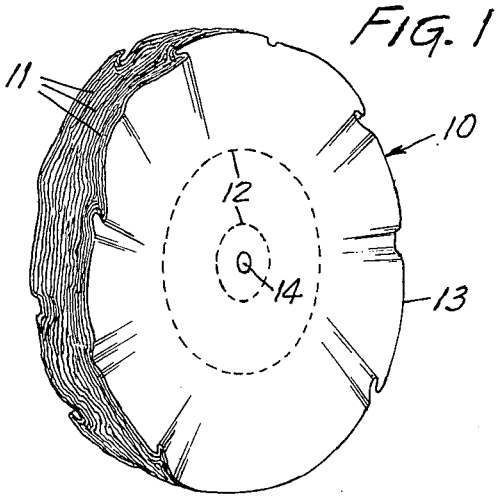

While it may be at first thought to be obvious to form a buff of non-woven synthetic fibrous fabric, it has been discovered, after much experimentation and evaluation, that such is not the case. It has been found that only certain non-woven fabrics provide a useful buff, as will hereinafter be explained.

The composition of the non-woven synthetic fabric going to form the buff of the invention dictates whether or not this product will be successful. The non-woven fabric is formed of flexible, durable, tough, resilient synthetic organic fibers having a length between about 1 cm and about 15 cm (preferably between about 2 cm and about 7.5 cm). Fiber lengths outside of this length range are difficult to form into a web fabric using the equipment presently available for this purpose.

Buffs formed of non-woven fabric consisting of coarse fibers, 8 denier and larger, do not hold as much buffing compound as buffs formed of non-woven fabric made of smaller denier fibers; therefore fiber sizes larger than 8 denier are not preferred. Buffs of coarse fibers may also provide a surface treatment which is too aggressive for conventional buffing. Fibers of about 8 denier or smaller may be used, but presently fiber deniers less than about three-fourths are unavailable because of manufacturing limitations. The preferred fiber denier is within the range of about 1 to 6, since fibers having a denier less than about 1 may produce a relatively weaker fabric which may not be able to withstand the forces encountered in all phases of buffing.

Fibers of relatively weak polymeric materials will not produce a buff with an economically useful wear life. Useful fibers should therefore have a breaking tensile strength of at least about 3.5 grams per denier. Buffs composed of fibers having a fiber breaking tensile strength of a least 5 grams per denier are preferred because they have sufficient strength to provide for a long wear life under a wide variety of conditions.

The fibers may be formed of any of a wide variety of synthetic organic fiber-forming polymers including both thermoplastic and thermosetting polymers, provided the fibers have the required physical properties described herein. The preferred polymers for fiber formation include nylon, both polyamide (e.g., that sold under the trade designation "Nomex" or "Kevlar") and polyimide, polyesters, preferably polyethylene terephthalate, high modulus viscose rayon, some acrylic polymers, and modacrylic polymers, but not conventional viscose rayon. Bicomponent fibers formed by coextruding two different polymeric materials are also useful. The synthetic organic polymers useful in the invention have a melting or decomposition temperature of at least 175°C to withstand the normal heat generated during the buffing operation. Polymers not withstanding at least this temperature may melt in use and smear the surface of the work piece being buffed with molten polymer and make the buff surface glazed, substantially reducing its buffing compound holding capacity. Polypropylene, for example, is not satisfactory because of its low melting temperature. The fibers should have the least degree of crimp required to be utilized on the web forming equipment.

The fibers previously described are bonded together at their points of intersection and contact with a water-, oil-, and grease- resistant synthetic organic binder which will form a strong adherent bond between fibers. The binder also has a melting or decomposition temperature above 175°C for the reasons given above. The cured binder is rigid but not brittle. The binder is applied as a liquid, e.g., as a solution or a dispersion, preferably as an aqueous solution, emulsion, dispersion or latex of the resin which may be thermoplastic or thermosetting. Exemplary preferred binders include acrylate polymers, available as acrylate emulsions such as that sold under the trade designation "Rhoplex" AC-172; acrylonitrile/butadiene polymers, e.g., sold under the trade designation "Hycar" 1571; polyvinyl chloride, available as a latex such as that sold under the trade designation "Geon" 460X1; and polyvinyl alcohol such as that sold under the trade designation "Gelvatol" 20–60.

The binder must be selected for and added to the fibers so as not to immobilze the fibers. Fiber immobilization does not allow fiber flexing and results in premature fiber breakage without the formation of "fuzz" on the buff's peripheral edge (buffing surface). The non-woven fabric should wear "fuzzy" rather than cleanly to hold buffing compositions and to provide the required buffing effect. Non-woven fabric having unbonded fiber ends on the periphery on the order of about 3 mm have been found to be sufficiently fuzzy to provide a useful buffing surface.

The type and amount of binder may be utilized to regulate the stiffness of the non-woven fabric of the buff to a certain degree. The inherent fabric stiffness, together with the sewing pattern regulate the stiffness of a sewn buff, while the inherent fabric stiffness, type of construction and/or addition of external stiffening agents, as previously described, regulates the stiffness of a puckered buff.

The binder generally comprises less than about 60 percent of the total weight of the non-woven fabric. Too much binder may produce a buff which could smear the surface of the article being buffed or which has a short wear life because of fiber immobilization. Typically, the binder content may vary between about 5 percent to about 60 percent of the total weight of the fabric depending upon the composition of the binder and of the fibers. When high modulus viscose rayon fibers are employed, a preferred binder is butadiene-acrylonitrile which may comprise from about 30–50 percent by weight of the non-woven fabric.

Fibers of the desired length and denier, as hereinbefore described, are processed on a suitable web forming machine into an integral sheet which is then impregnated with the binder resin and dried to form the non-woven fabric. The preferred equipment for forming the non-woven fabric is the "Rando-Webber" apparatus variously described in Buresh U.S. Pat. Nos. 2,744,294, 2,700,188 and 2,451,915 and Langdon et al U.S. Pat. No. 2,703,441.

The non-woven fabric has a density on the order of 0.1 to 0.6 grams per cc (preferably 0.15 to 0.35 grams per cc), which is relatively light-weight when compared to the density of woven cotton fabric which is on the order of 0.5 to 0.6 grams per cc. The cotton buff is thus from about 1 to 6 times heavier than the buff of the invention, resulting in considerable savings in materials and shipping costs for the buff of the invention.

When making a sewn buff, layers of the non-woven fabric are first cut into any desired rough dimensions and stacked one on another to form a pile of the desired thickness. Buffs are then cut from the pile utilizing a conventional cutting device such as a stamping die. Sewing is preferably accomplished before cutting. When forming a puckered buff, the non-woven fabric is cut into a continuous strip of any desired width and wrapped around the forming mandrels to a total thickness of 1/2 the final buff thickness. The puckered buff is then formed in the manner previously described and the fabric is then die-cut to provide a buff of desired diameter.

The buff of the invention will be comprised of one or more non-woven fabric layers having a thickness of at least 0.1 mm. At less than 0.1 mm, the fabric layers tear easily and thus have a very short uneconomical use life. Typical fabric layers are on the order of 0.25 to 0.4 mm thick. The puckered buff will be somewhat thicker (e.g., 0.4 – 0.75 mm), since its configuration requires more strength. It is presently difficult to make fabric layers thicker than about 0.75 mm because as more and more fibers are laid down to thicken the fabric layer, the binder migrates to the surface, resulting in a fabric layer which easily delaminates because it is insufficiently bonded into its interior.

WEAR TEST

An important aspect of the invention is applicants' discovery of a buff fabric wear test to determine which combinations of synthetic organic fibers and binders described above will produce a commercially useful buff. The fabric wear test involves first preparing a test buff which consists of 4 sections of about 20 layers each of non-woven fabric to make a total buff thickness of approximately 2.5 cm. The test buff has a 25 cm outer diameter, is spirally sewn with about 0.6 cm between spirals, and has a 3.2 cm diameter central opening. To test the wear of a puckered buff, two side by side 40 cm diameter puckered test buffs are used. Each puckered test buff has a total fabric thickness (exclusive of puckering) of about 0.5 cm. The weight of the fabric portion of the test buff is then determined (exclusive of any clinch rings or arbors) and the buff is mounted on a shaft for rotation, using 15 cm diameter flanges for sewn buffs and 20 cm diameter flanges for puckered buffs to firmly hold the buff in place. A wear-test head is provided by eleven 8.41 cm × 2.54 cm × 1.1 mm steel blades (each sharpened on a 8.41 cm edge by beveling from one side) separated by two 6.4 mm thick spacers between blades and placed in a holder with the sharp edges in the same direction and the beveled sides down, so that the total distance between the outside blades is 13.8 cm. The wear-test head is centered with the middle blade radially aligned with respect to and touching the peripheral edge of the test buff, the remaining blade edges lying in the plane tangent to the peripheral edge of the buff, and the blade holder in a vertical position. The wear-test head is then fastened in a mechanical carriage which causes it to travel 14 cm in an up and down motion, with 6.8 kg force against the buff so that the buff rotates against the blades. If wear occurs during a cycle, the wear-head is readjusted to keep the wear-test head vertical for the next cycle. Each test buff is subjected to 10 wear cycles, with adjustment if necessary, after each cycle to maintain the correct contact between the blades and the buff. After 10 cycles the buff is reweighed and the percent weight loss (from the fabric) is determined. Buffs having a weight loss of less than 20 percent will generally have a commercially useful life.

HEAT-RESISTANT BUFFS

Certain combinations of synthetic fibers and binders have been found, quite surprisingly, to provide a heat-resistant buff which can be used in high temperature environments such as for wiping molten solder from freshly soldered metal container seams. Such buffs will generally have a configuration such as depicted by FIG. 1 of the drawing. Cotton buffs have been used for this purpose in the past with limited success because cotton tends to char badly and sometimes actually burns after very short use time. Woven cotton cloth also tends to unravel when used for solder wiping applications, resulting in a non-uniform wiping surface.

In wiping molten solder, the buff should be capable of withstanding brief contact with a heated metal surface of about 370°C without melting or excessive charring. If either the fiber or the binder in the buff melts in this situation, the surface of the wiper will become glazed and hard and will not evenly wipe the molten solder from the seam, leaving an irregular seam which may prevent proper application of the can covers.

The buffs according to the invention which perform satisfactorily as solder wiping devices are composed of non-woven fabric which contains heat- and flame-resistant fibers and binders. Heat- and flame-resistant fibers and binders are stable at elevated temperatures above about 175°C and decompose (rather than melting or burning) above this temperature to produce by-products which will not interfere with the solder wiping. Some typical examples of heat- and flame-resistant fibers include high temperature resistant nylon such as that sold under the trade designation "Nomex," high strength and high modulus nylon such as that sold under the trade designation "Kevlar" 29, and flame-retardant rayon. These fibers are adhered together using a flame-retardant binder such as polyvinyl chloride, for example, such as that sold under the trade name "Geon" 460X1, or vinylidene chloride-butadiene, e.g., that sold under the trade designation XD8260.04.

To perform satisfactorily as a solder wiper, the non-woven fabric should be soft, uniform and firm, but flexible. Suitable fabrics will have a "fuzzy" peripheral surface, as hereinbefore defined, which will be firm enough to exert some pressure on the surface being wiped, but the fabric layers will not be so stiff as to be easily forced apart to cause a non-uniform surface.

An especially preferred solder wiping buff is formed of a mixture (most preferably equal parts) of high temperature resistant nylon fibers such as those sold under the trade designation "Kevlar" and "Nomex" bonded together with a binder comprised of a mixture of a major portion of polyvinyl chloride and a minor portion of polyvinyl alcohol.

The buffs of the invention are illustrated by the following nonlimiting examples, wherein all parts are by weight unless otherwise specified.

EXAMPLE 1

Figure 2:
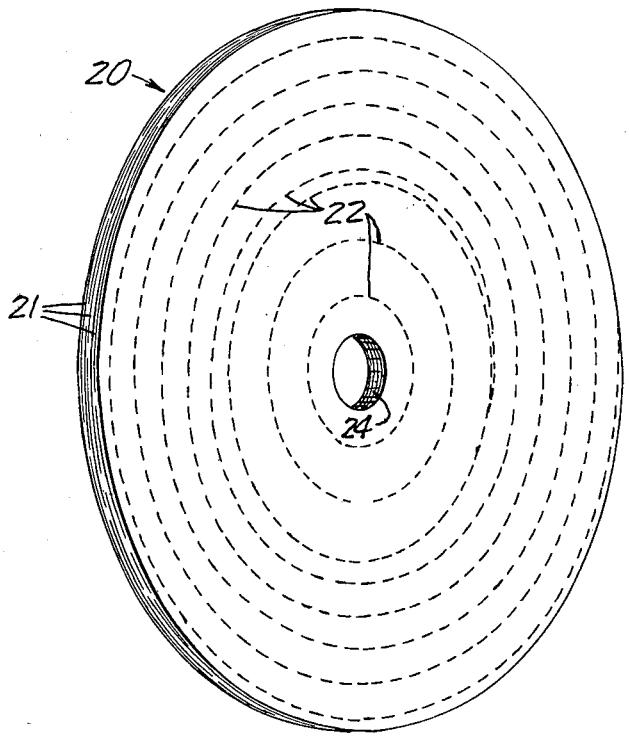
Figure 3:
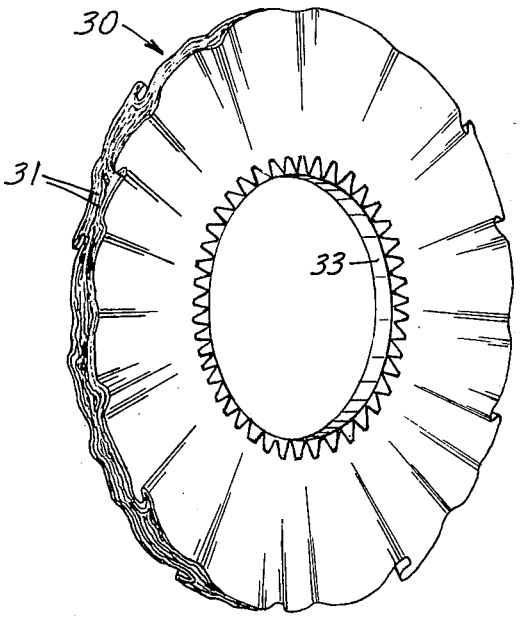

This example describes the manufacture of a buff such as depicted in FIG. 2 of the drawing.

A polyvinyl alcohol stock solution is first prepared by mixing 10 parts polyvinyl alcohol (such as that sold under the trade designation "Gelvatol" 20–60 by the Monsanto Corporation), 89 parts soft water, one part triethylene glycol plasticizer, 0.2 part 2-ethylhexanol anti-foam agent and 0.2 part surfactant such as that sold under the trade designation "Victawet 35B." A saturating solution is then prepared by mixing 17.5 parts stock solution, 52.5 parts water, 0.18 parts ammonium chloride catalyst and 0.35 part dimethylol urea insolubilizer.

A light weight open non-woven air-laid web is then formed on a "Rando-Webber" machine, commercially available from the Curlator Corporation of Rochester, New York. The web is formed of a blend of 80 parts three denier, 4 cm, high modulus viscose rayon fibers and 20 parts 1.5 denier, 4 cm, high modulus viscose rayon fibers. (The fibers are sold under the trade designation "Fiber 40" by the FMC Corporation). Initially, the fibers are fed into a conventional garnett machine to loosen and separate them. The loose staple from the garnett machine is then transferred into the feed hopper of the "Rando-Webber" machine and the machine is then started and adjusted to form a random web having a weight of about 40 grams per square meter. The web is then led onto a continuous conveyor belt from which it is passed between nip rolls that are continuously being supplied with the saturating solution described above. The nip rolls are operated at a roll to roll pressure of 5.4 kg per cm. The lower nip roll is a 17.5 cm diameter rubber roll having a Shore A durometer of about 70 and a grooved surface to increase the solution carrying capacity, which roll rotates in a bath of the solution. The upper nip roll is a 12.7 cm diameter steel roll having helical grooves over its surface to increase solution carrying capacity. The upper roll is supplied with solution which is spread uniformly over its surface by a doctor blade. From the nip rolls, the coated web passes to another conveyor belt which carries the coated web into a 6.1 meter drying and curing oven heated at 175°C and provided with a hot air supply. The web is dried until substantially all of the solvent is removed and the web is non-tacky to touch. The resultant 0.25 mm thick web has a density of 0.18 g/cc.

After removal from the oven, the web is cut into squares slightly larger than 25 cm on an edge, 25 web segments stacked one on another and the stack sewn in a spiral pattern beginning at a 3 cm radius and continuing to the outside edge of the stack with approximately 8 mm between seams and about 2.4 stitches per cm. The needle thread is Style No. 83025 (16/4) left twist cotton thread sold by the Conso Company and the bobbin thread is Style No. 83060 (24/4) left twist thread by the same company.

A buff is cut from the sewn stack utilizing a 25 cm diameter die having a 3.1 cm center punch for the arbor hole. When evaluated for wear, the buff has a weight loss of 5.2 percent.

This buff may be used to impart a high color finish on cast brass articles with a commercial buffing composition sold under the trade designation "Formax" tripoli buffing compound type T-2 (very dry), by Formax Manufacturing Corporation of Detroit, Michigan.

EXAMPLES 2 – 10

In Examples 2–10, the non-woven fabric was made substantially as described in Example 1, with variations therefrom being noted in Table I. The characteristics of each buff are shown in Table II. Table III reveals some characteristics of prior art cotton buffs.

TABLE I

| | FIBER | | | | | BINDER | | FINISHED WEB | | |
|---|---|---|---|---|---|---|---|---|---|---|
| Ex. No. | % | Size (denier) | Length (cm) | Break Strength (g./denier) | Composition | % | Composition | Binder Weight (%) | Weight g/m² | Thickness (mm) |
| 1 | 80 | 3 | 4.0 | 5.0 | High modulus viscose rayon | 100 | Polyvinyl[1] alcohol | 6 | 40.7 | 0.25 |
| | 20 | 1.5 | 4.0 | 5.0 | " | | | | | |
| 2 | 100 | 3 | 5.0 | 5.0 | " | 100 | Butadiene-acrylonitrile[2] | 43.5 | 94.9 | 0.31 |
| 3 | 100 | 3 | 5.0 | 5.0 | " | 10 | PVA[1] | | | |
| | | | | | | 90 | Butadiene-acrylonitrile[2] | 40.7 | 86.5 | 0.31 |
| 4 | 100 | 3 | 5.0 | 5.0 | " | 100 | Acrylic poly- | 32.7 | 64.4 | 0.30 |

TABLE I-continued

| Ex. No. | FIBER % | Size (denier) | Length (cm) | Break Strength (g./denier) | Composition | BINDER % | Composition | FINISHED WEB Binder Weight (%) | Weight g/m² | Thickness (mm) |
|---|---|---|---|---|---|---|---|---|---|---|
| | | | | | | | mer[3] | | | |
| 5 | 100 | 6 | 3.8 | 9 | Nylon[4] | 89 | Butadiene-acrylonitrile[2] | | | |
| | | | | | | 11 | PVA[1] | 52 | 108.5 | 0.51 |
| 6 | 100 | 2.3 | 3.8 | 5.5 | Nylon[5] | 100 | Butadiene-acrylonitrile[2] | 42 | 108.5 | 0.38 |
| 7 | 60 | 2.3 | 3.8 | 5.5 | Nylon[5] | 94 | Butadiene-acrylonitrile[2] | | | |
| | 40 | 6 | 3.8 | 9 | Nylon[4] | 6 | PVA[1] | 35 | 98.3 | 0.43 |
| 8 | 100 | 2.3 | 3.8 | 5.5 | Nylon[5] | 57 | Butadiene-acrylonitrile[2] | | | |
| | | | | | | 38 | Acrylic polymer[3] | | | |
| | | | | | | 5 | PVA[1] | 46 | 125.5 | 0.51 |
| 9 | 100 | 2.3 | 3.8 | 5.5 | Nylon[5] | 94 | Butadiene-acrylonitrile[2] | | | |
| | | | | | | 6 | PVA[1] | 45 | 128.8 | 0.48 |
| 10 | 50 | 1.5 | 3.8 | 22 | Nylon[6] | 77 | PVC[7] | | | |
| | 50 | 5.5 | 3.8 | 5.3 | Nylon[8] | 23 | PVA[1] | 25 | 71.2 | 0.43 |
| 11 | 50 | 1.5 | 3.8 | 22 | Nylon[6] | 8 | PVA[1] | | | |
| | 50 | 5.5 | 3.8 | 5.3 | Nylon[8] | 92 | PVC[7] | 47 | 79.9 | 0.42 |
| 12 | 25 | 1.5 | 3.8 | 22 | Nylon[6] | | | | | |
| | 75 | 5.5 | 3.8 | 5.3 | Nylon [8] | 100 | PVC[7] | 40 | 98.3 | 0.58 |

Footnotes
[1]Polyvinyl alcohol (PVA) sold under the trade designation "Gelvatol" 20–60 by the Monsanto Company.
[2]Sold under the trade designation "Hycar" 1571 by the B. F. Goodrich Company.
[3]Sold under the trade designation AC-172 by the Rohm and Haas Company.
[4]Type P113 nylon (polyamide) fibers sold by the E. I. DuPont de Nemours Company.
[5]Type 420 nylon (polyamide) fibers sold by the E. I. DuPont de Nemours Company.
[6]Aromatic nylon (polyamide) fibers sold under the trade designation "Kevlar 29" by the E. I. DuPont de Nemours Company.
[7]Polyvinyl chloride sold under the trade designation "Geon" 460X1 by the B. F. Goodrich Company.
[8]High temperature resistant nylon (polyamide) fibers sold under the trade designation "Nomex" by the E. I. DuPont de Nemours Company.

TABLE II

| Ex. No. | Type | BUFF CHARACTERISTICS Buffing Surface | Fabric Density (g/cc) | Number of Plies | Diameter (cm) | % Wear |
|---|---|---|---|---|---|---|
| 1 | Spiral Sewn 8 mm | very soft | 0.180 | 25 | 25 | 5.2 |
| 2 | Spiral Sewn 6 mm | soft | 0.293 | 20 | 25 | 5.1 |
| 3 | Spiral Sewn 6 mm | medium | 0.281 | 20 | 25 | 5.0 |
| 4 | Spiral Sewn 6 mm | hard | 0.233 | 21 | 25 | 2.4 |
| 5 | Puckered | soft | 0.21 | 14 | 40 | 2.2 |
| 6 | " | medium | 0.25 | 12 | 40 | 1.9 |
| 7 | " | hard | 0.26 | 12 | 40 | 2.2 |
| 8 | " | hard | 0.25 | 12 | 40 | 2.3 |
| 9 | " | hard | 0.28 | 12 | 40 | 3.2 |
| 10 | Solder Wiper | very soft | 0.16 | 15 | 12.7 | 16 |
| 11 | " | very soft | .19 | 20 | 12.7 | — |
| 12 | " | very soft | .14 | 15 | 12.7 | — |

TABLE III

| Ex. | Type | COTTON CONTROL BUFFS Buffing Surface | Threads per inch (2.5 cm) | Fabric Density (g/cc) | Number of Plies | Diameter (cm) | % Wear |
|---|---|---|---|---|---|---|---|
| A | Spiral Sewn 9 mm | medium | 59 × 70 | 0.485 | 26 | 25 | 5.4 |
| B | Spiral sewn 9.5 mm | soft | 86 × 105 | 0.510 | 20 | 25 | 5.6 |
| C | Spiral sewn 6 mm | hard | 75 × 78 | 0.653 | 35 | 25 | 5.3 |
| D | Puckered | medium | 86 × 93 | 0.6 | 16 | 40 | 3.4 |
| E | Puckered | medium | 82 × 82 | 0.6 | 16 | 40 | 4.2 |
| F | Solder Wiper | very soft | 64 × 64 | 0.6 | 35 | 13 | — |

EVALUATION OF SOLDER WIPING

The solder wiping buffs were evaluated in a container production line wherein metal sheet stock was formed into cylinders, the cylinders were carried on a conveyor to a gas flame heating station where their abutted ends were heated, sufficient molten solder was applied to the heated ends to provide an excess and the seam was reheated at a second gas flame heating station immediately prior to entering a wiper zone containing a solder wiping buff. The buff was located beneath the can conveyor in a vertical position so that the wiper's axis of rotation was perpendicular to the direction of the can travel. The wiper rotated so that its working surface moved in the opposite direction of the container's travel with the container's cylindrical axis being in the direction of the conveyor's movement.

Evaluation results of buffs according to the invention (Examples 11 and 12) and control cotton buffs (Example F) are shown in Table IV.

TABLE IV

| Ex. | Containers per min. | Time to Failure (hrs.) | Reason for Failure |
|---|---|---|---|
| 11 | 440 | 9 | Buffing surface became irregular due to wear |
| F | 440 | 5 | Severe charring and discontinuities in buff surface |
| 12 | 240 | 2.5 | Buffing surface became irregular due to wear |
| F | 240 | 0.3 | Buff badly charred and on fire |

What is claimed is:

1. A rotary buff comprised of a plurality of layers of non-woven fabric held together by fastening means, said non-woven fabric having a fabric density on the order of 0.1 to 0.6 grams per cc, being at least about 0.1 mm thick and consisting essentially of a multiplicity of randomly disposed, adhesively bonded, flexible, durable, tough, resilient organic fibers no larger in size than about 8 denier, having a length on the order of 1 cm to 15 cm and a break strength of at least about 3.5 grams per denier, said fibers being formed of a synthetic organic fiber-forming polymeric material having a melting or decomposition temperature above about 175°C, said fibers being firmly adhesively bonded at points where they cross and contact one another to form a uniform web with a rigid but not brittle binder material which has a melting or decomposition temperature above about 175°C, said binder material being contained in said fabric in an amount sufficient to firmly adherently bind said fibers together but insufficient to immobilize said fibers.

2. The buff of claim 1 wherein said fiber length is from 2 to 8 cm.

3. The buff of claim 1 wherein said fiber denier is from 1 to 6.

4. The buff of claim 1 wherein said fiber break-strength is at least 5 grams per denier.

5. The buff of claim 1 wherein said organic fiber-forming polymeric material is selected from the group consisting of nylon, polyester, and high modulus viscose rayon.

6. The buff of claim 1 wherein said fastening means is sewing.

7. The buff of claim 1 wherein said fastening means is stapling.

8. The buff of claim 1 wherein said fastening means is a clinch ring.

9. The buff of claim 1 wherein said fastening means is adhesive bonding.

10. The buff of claim 1 wherein said binder material is selected from the group consisting of acrylonitrile-butadiene polymers, acrylate resins, polyvinyl chloride, polyvinyl alcohol and mixtures of these materials.

11. The buff of claim 1 wherein said organic fiber forming material and said binder material are flame and heat resistant.

12. A rotary buff comprised of a plurality of layers of non-woven fabric held together by fastening means, said non-woven fabric having a fabric density on the order of 0.15 to 0.35 grams per cc, being about 0.25 to 0.4 mm thick and being comprised of a multiplicity of randomly disposed, adhesively bonded, flexible, durable, tough, resilient high modulus viscose rayon fibers of a size on the order of 1 to 6 denier, having a length on the order of 2 to 7.5 cm and a break-strength of at least about 5 grams per denier, said fibers being firmly adhesively bonded at points where they cross and contact one another with from about 30 percent to about 50 percent by weight of butadiene acrylonitrile binder material which has a melting or decomposition temperature above 175°C.

13. A rotary buff especially suited for use in wiping molten solder from freshly soldered metal container seams, said buff comprised of a plurality of layers of nonwoven fabric held together by fastening means, said non-woven fabric having a fabric density on the order of 0.15 to 0.35 grams per cc, being about 0.25 to 0.4 mm thick and consisting essentially of a multiplicity of randomly disposed, adhesively bonded, flexible, durable, tough, resilient nylon fibers on the order of 1 to 6 denier, having a length of about 2 to 7.5 cm and a break strength of at least about 5 grams per denier, said fibers bonded together with a binder material consisting essentially of a major portion of polyvinyl chloride and a minor portion of polyvinyl alcohol, said nylon fibers and said binder material being flame and heat resistant.

14. A rotary puckered buff comprised of puckered layers of non-woven fabric held together by a rigid clinch, said non-woven fabric having a fabric density on the order of 0.1 to 0.6 grams per cc, being about 0.4 to 0.75 mm thick and consisting essentially of a multiplicity of randomly dispersed adhesively bonded, flexible, durable, tough, resilient organic fibers no larger in size than about 8 denier, having a length on the order of 1 cm to 15 cm and a break strength of at least about 3.5 grams per denier, said fibers being formed of a synthetic organic fiber-forming polymeric material having a melting or decomposition temperature above about 175°C, said fibers being firmly adhesively bonded at points where they cross and contact one another to form a uniform web with a rigid but not brittle binder material which has a melting or decomposition temperature above about 175°C, said binder material being contained in said fabric in an amount sufficient to firmly adherently bind said fibers together but insufficient to immobilize said fibers.

15. The buff of claim 14 wherein said polymeric material is nylon.

* * * * *